United States Patent [19]

Linga et al.

[11] Patent Number: 4,944,672

[45] Date of Patent: Jul. 31, 1990

[54] METHOD FOR RENOVATING RING CHAMBER FURNACES

[75] Inventors: Hogne Linga; Carlo Eliassen, both of Årdalstangen, Norway

[73] Assignee: Norsk Hydro A.S., Oslo, Norway

[21] Appl. No.: 310,833

[22] Filed: Feb. 8, 1989

[30] Foreign Application Priority Data

Feb. 8, 1988 [NO] Norway ..... 880532

[51] Int. Cl.[5] ..... F27B 5/02; F27B 5/16

[52] U.S. Cl. ..... 432/3; 432/192

[58] Field of Search ..... 432/192, 186, 3, 76

[56] References Cited

U.S. PATENT DOCUMENTS 4,284,404 8/1981 Genevois et al. ..... 432/192

4,371,333 2/1983 Moser et al. ..... 432/3

4,552,530 11/1985 Gunnes et al. ..... 432/192

*Primary Examiner*—Henry C. Yuen

*Attorney, Agent, or Firm*—Wenderoth, Lind & Ponack

[57] ABSTRACT

A method for the renovation of a ring section furnace having several sections connected in series, each section comprising a plurality of parallel pits. A complete renovation/maintenance of the furnace is accomplished according to a continuous program where one or more, preferably three sections at a time and when needed, are torn down and rebuilt while the remaining sections are still in operation. During normal operation, several adjacent sections are undergoing a firing cycle and constitute a firing zone. The furnace is normally operated with a plurality of firing zones separated by inactive adjacent sections having the work material removed from or placed therein. In the present method, the firing cycles of less than all of the firing zones are altered until the minimum number of inactive sections separates at least two of the firing zones. This results in an increase in the inactive sections at another point. Revonvation/maintenance is carried out in the increased inactive sections prior to arrival of the next firing zone. The firing cycles are then altered to achieve the normal firing zone spacing.

6 Claims, 5 Drawing Sheets

METHOD FOR RENOVATING RING CHAMBER FURNACES

FIELD OF THE INVENTION

The present invention relates to a method for the renovation of ring section furnaces.

DESCRIPTION OF THE PRIOR ART

For baking carbon bodies for cells for the electrolytic reduction of aluminia or for other electrometallurgical processes, special furnaces are used for the heat treatment (baking or calcining) of such carbon bodies.

The carbon bodies are made in the required shape from a mixture of crushed coke or anthracite and a binding agent which, for example, contains coals, tar and pitch.

At room temperature, the mixture of coke and binder is stiff, but it becomes soft at temperatures over about 120° C. giving off low-volatile components from the binder. When subjected to further heating over a period of time, to a maximum of 1,300° C., the paste hardens, and its physical properties, such as electrical conductivity and resistance against oxidation, change. Carbon bodies awaiting baking are usually referred to as "green carbons". These grey carbons may weigh several tons and a have length of 2 meters and more. To prevent their becoming deformed when passing through a temperature range in which they become soft, special precautions have to be taken. The green carbons are placed in deep pits in the furnace which is made of refractory bricks. The space between the carbons and pit walls are filled with coke to support the carbons. Coke breeze also serves to protect the carbon against air combustion.

Several pits are built adjacent to one another, thereby forming a so-called section. In the walls between the pits there are channels, or ducts, for flue gasses. Heat is supplied to the carbons by passing the flue gasses through these ducts. The flue gasses from one section pass, through ducts, to the adjacent section. In this manner, the flue gasses can pass through several sections connected in series in a so-called firing zone. The usual fuels are oil or gas. The flue gas vent and the burner manifold can be moved from section to section.

In a large ring furnace, there may well be two rows of sections built along side one another, thus forming parallel rows. At the end of a section row, the flue gas ducts are connected to the ducts in the parallel section row. In this way, the sections are joined together forming a ring. It is for this reason that such a furnace for baking carbon bodies is known as a ring section furnace.

In a ring section furnace there may be several firing zones in which the temperature is regulated according to a given program. The first sections in a firing zone have low temperatures. These are followed by sections with higher temperatures, while the final stage in a firing zone consists of those sections in which the carbons are cooled.

In a furnace of conventional design, each section is closed at the top by means of a section cover, and this has to be removed when green carbons are to be charged or baked carbons removed.

On account of the special properties of carbon bodies it is necessary to avoid large temperature gradients during baking, as these would result in cracks in the final product. Each section must therefore follow an exact time and temperature program. In the first part of the zone, the heating is up to 600° C. by the heat in the flue gasses from the last part of the firing zone. Later, in the temperature range from 600° C. to the required top temperature (1,200°–1,300° C.) the heat must be supplied by the above mentioned combustion of gas and oil.

In the cooling zone, the pit walls are cooled by air until the carbons can be removed without danger of oxidation. Steps are taken to make the best possible use of the heat absorbed by the cooling air, by using this air for combustion.

The firing zone is moved by moving the oil or gas burners from one section to the next. The frequency of this operation is referred to as the heating cycle, and determines the capacity of the firing zone.

As already mentioned, it must also be possible to connect a gas exhaust system to a section to be converted to the firing zone. This is usually achieved by connecting a fan between this section and a pipe connection on an exhaust duct around the furnace. This exhaust duct is referred to as the flue ring main, and is kept under negative pressure by a main fan.

In connection with the renovation of the furnaces, damage occur in the form cracks or the like due to thermical and mechanical strain and stress. Minor damage is continuously taken care of in connection with, the regular maintenance. However, after some time the damage is so extensive that a complete renovation has to be accomplished. Depending on the use and quality of the furnace, complete renovations have to take place after 8–10 years. On account of the extensive work to be done, the furnaces will have to be closed down for a longer period of time, and this will again result in production losses which may amount to large economic losses.

Besides, when such extensive renovations are carried out, several workers and expensive equipment is needed to shorten the renovation period, and this can sometimes be difficult to provide.

The condition for the individual section (pit wall, section wall etc.) determines when a complete renovation should take place. Thus, the renovation is determined by the so-called "weakest link in the chain"-principle. This implies that the furnaces are completely renovated before all the sections have lasted their full life. Hence, another disadvantage with the complete renovations is that average life of the sections is reduced.

SUMMARY OF THE INVENTION

It is an object with the present invention to avoid the above disadvantages by providing a method for the renovation of ring section furnaces by which;

the production losses are eliminated or vastly reduced, less equipment and personnel is needed in connection with the renovation, the average life for the sections is prolonged, it is possible to rebuild an old type furnace to a new type ring section furnace.

BRIEF DESCRIPTION OF THE DRAWINGS

The invention will now be further described by way of example and with reference to the drawings in which.

DETAILED DESCRIPTION OF THE INVENTION

The present invention can be employed both on the older type ring section furnace, the so-called Riedhammer furnace, as well as the new type of ring section furnace which has been designed by the applicant and which is further described in the Norwegian patent specification No. 152.029. The constructional design and operation of these furnaces will now be further described.

Figure 1:
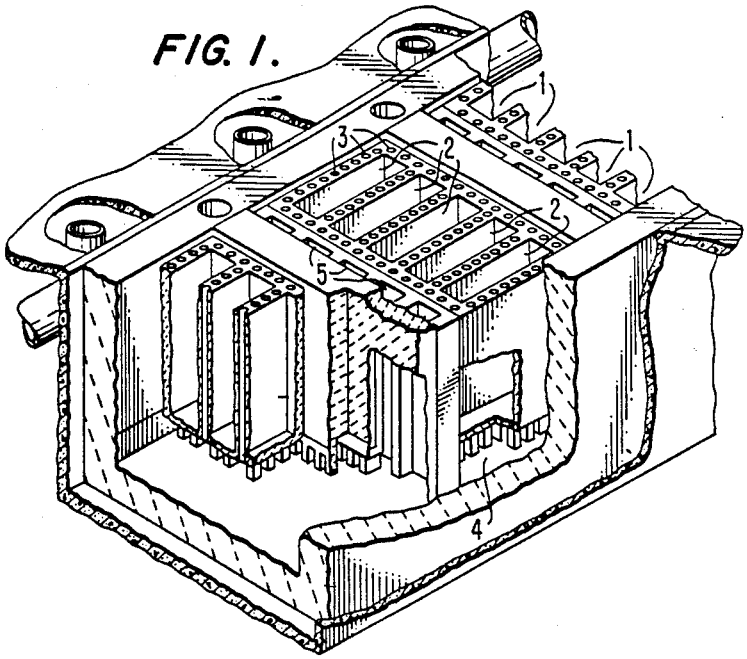
FIG. 1 is a perspective cross sectional view of a known ring section furnace.

FIG. 1 is a partially cut-away illustration of an a section of earlier design with five pits 1. In pits walls 2 there are flue gas ducts 3 through which flue gases flow downwards from the space under the section cover (not shown) and down into a space 4 under the bottom of the pits 1. The upward flow of the flue gases from below is through combustion chambers 5.

Figure 2:
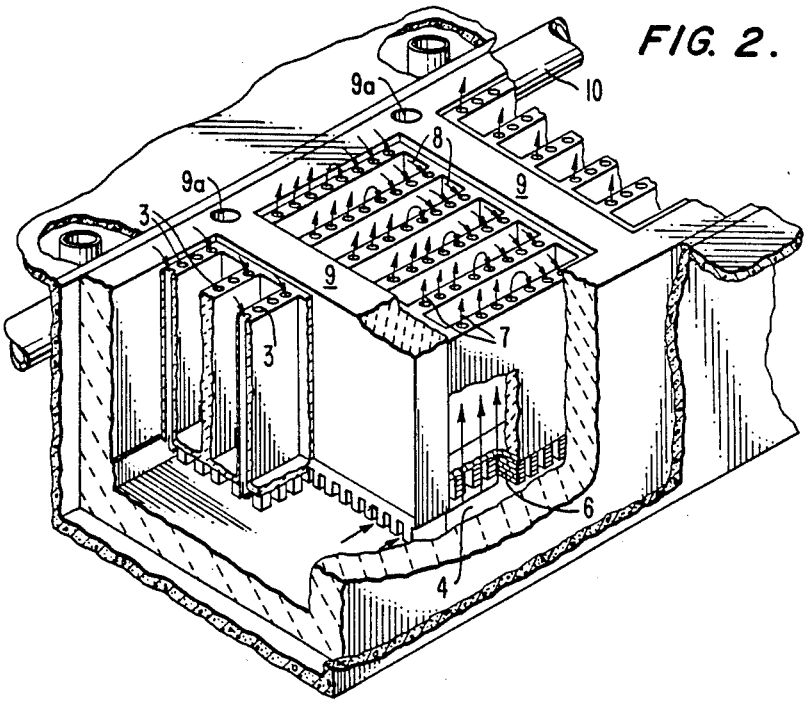
FIG. 2 is a perspective cross sectional view of sections in a ring section furnace according to a new principle.

In FIG. 2 is a similar section from which the combustion chambers have been removed. Under the bottom of the pits there is provided a partition wall 6 which divides the space under the pits in two. In this manner, the flue gases flow upwardly through one group 7 of gas ducts 3 and downwardly through another group 8 thereof.

In operation, a cover plate rests on section walls 9. This cover plate is not shown, but will, in FIG. 1 as in FIG. 2, ensure that the gas flow is through the appropriate ducts.

From the space under the pits there is a duct (not shown) to pipe connector points 9*a* on the top of the furnace. These are used for connecting the individual sections to the flue ring main 10.

Firing can, as previously mentioned, be performed in several ways. The fuel can be fed, in whole or in part, into the space over each pit wall.

Combustion can also be achieved with insufficient air being fed to the space or spaces into which the fuel is injected; more being added in one or several space(s) downstream. By feeding the air to point 4, heating can also be localized to the bottom of the pits without the fuel carbonizing.

Figure 3:
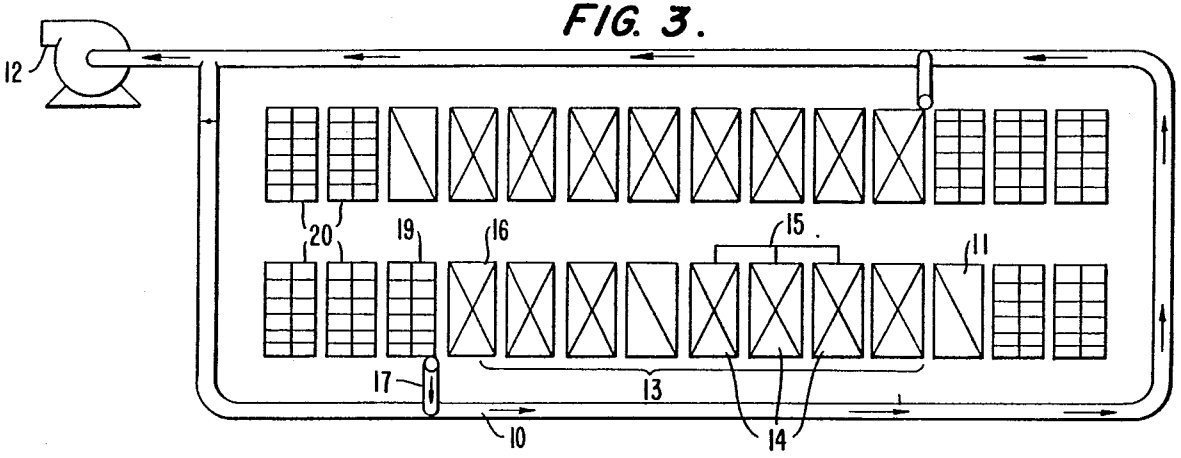
FIG. 3 is a diagram illustrating a ring section furnace with two firing zones.

FIG. 3 is a view looking downwardly onto a ring section furnace with two firing zones. In each of the firing zones there are combustion chambers at different stages. 11 denotes a section from which the section cover has been removed. Air is being drawn in through the one half in the direction of the section in which firing is now taking place. The carbons in this section 11 are cooled by means of air which is drawn in by exhaust fan 12, and this air is thus preheated before it reaches the burners. 13 represents a section, the top of which is sealed with a cover plate so that the cooling air from 11 is drawn through the ducts in the pit walls, upwards through the first half and downwards through the second half, up to the next sections 14 which have oil or gas burners 15.

16 indicates the section in the firing zone from which the flue gases are exhausted by means of connecting pipes 17 to the flue ring main 10. 19 indicates the section with covered gas ducts in the one half so that air cannot be drawn in in the direction opposite to the heating cycle. 20 denotes open sections from which the baked carbons are removed and the open carbons inserted. The gas scrubber and stack are not shown.

Figure 4:
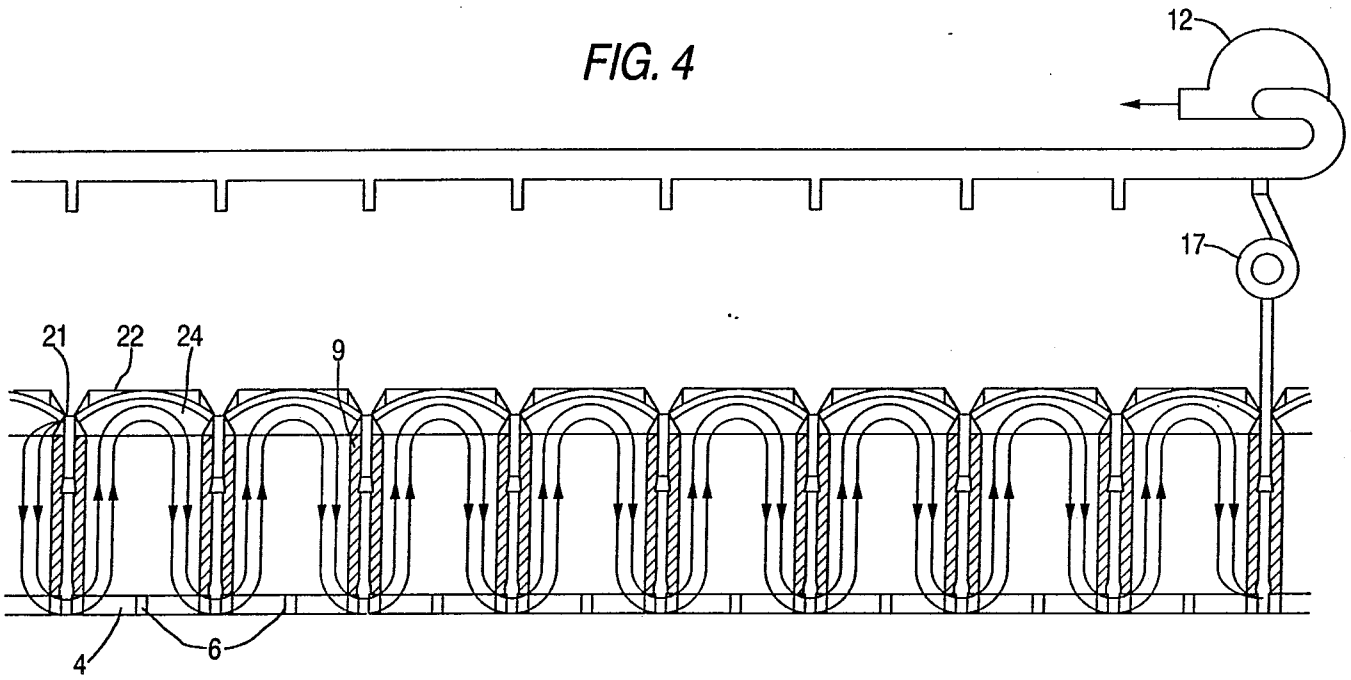
FIG. 4 is a diagram illustrating flue gas flow in a firing zone.

FIG. 4 shows, in diagram form, the gas flow in a firing zone in a ring section furnace according to the simpler embodiment of the invention. Air 21 enters the section at the left and is drawn through group 8 of gas ducts 3 down into space 4 under the bottom of the pits 1 of such section and is led through ducts in wall 9 to the next section with cover plate 22 which closes off space 24. Here, the flue gases are drawn up through the ducts 3 in the first half 7 of the section and down through the ducts 3 in the pit walls in the other half 8, and then onto the next section.

In the above is described how an older type (FIG. 1) and a new type of ring section furnace (FIG. 2) are designed and how the furnaces are operated. It is also previously described how such furnaces, after some time in operation, are completely renovated, i.e. by stopping the operation of the furnaces, by cooling to room temperature, and thereafter by tearing them down and rebuilding them.

With the present invention a new principle has been revealed by which a complete renovation of ring section furnaces has been made possible even though the furnaces are still in operation. Further described, the invention is characterized in that the complete maintenance or renovation of a ring section furnace is carried out in accordance with a continous maintenance program where one or more, preferably three sections at a time and when needed, are torn down and thereafter rebuilt while the furnace is still running. To make such tearing down and rebuilding possible, the firing zones have to be asymmetrically operated relative to one another, which will be further described in the following by means of an example.

As previously mentioned, the present invention can be applied to both the older and the new type of ring section furnaces. However, the method according to the invention can also be applied for the rebuilding of the older type to the new type of such furnaces, and the example refers to such rebuilding.

EXAMPLE.

After several years of operation, damage has been discovered in the form of severe cracks in the refractory material of which a ring section furnace is built, and it has been decided that a complete renovation of the furnace is necessary.

The furnace is of the traditional Riedhammer type with vertical flue gas ducts, and it is therefore contemporaneously decided that the furnace should be rebuilt to the new furnace concept. Such rebuilding implies that a partition wall has to be built at the bottom underneath the pits; that the lids are provided with a sluice for horizontal firing; that the combustion chambers are removed and that a channel is built in the section wall (FIG. 2, pos. 9*a*). Being a part of the regular maintenance, all of the pits, bottom plates and pillars are exchanged. The reason for contemporary rebuilding the furnace to the new concept is that heat conduction to the carbon will be improved and the space utilization is increased by 33.3% without having to alter the outer measurements of the furnace. Besides, an increased productivity is achieved by running the furnace at a higher pace compared to the older type.

One chooses to divide the furnace into three units counting three sections, and has found that the rebuilding should start with sections 1, 2 and 3 with adjacent section walls, i.e. the section wall for section 2 and the section wall between sections 1–2 and 2–3.

The rebuilding as such will now be described step-by-step with reference to FIG. 5. However, it should be stressed that the dates mentioned are arbitrarily chosen and are only used to improve the clarification of the invention.

Figure 5A:
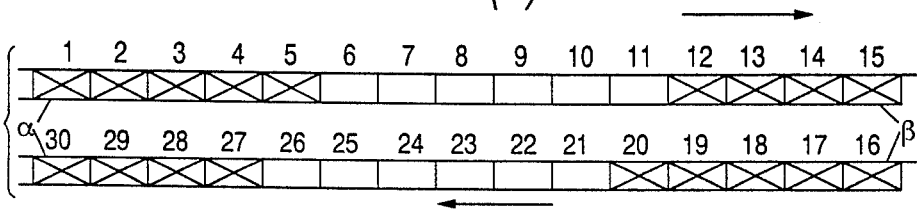
FIGS. 5(*a*)-(*d*) are diagrams illustrating the firing zone situation for different steps of the method according to the invention.
Figure 5B:
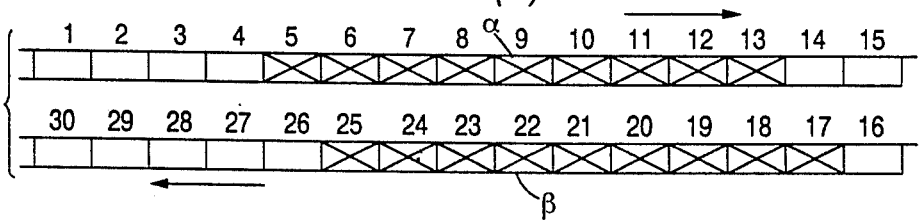

1. The furnace comprises 30 sections and has two firing zones $\alpha$ and $\beta$. The zone $\alpha$ currently comprises sections 1–5 and 27–30, whereas the zone $\beta$ currently sections 12–15 and 16–20. This is shown in FIG. 5A.

It is decided that the asymmetrical running of the furnace should start on February 10 at 6 o'clock pm. This is done by setting the zone $\alpha$ with section 20 in front on a 48 hour heating cycle, whereas zone $\alpha$ is running at 30 hours heating cycle, as is common.

2. After 10 days, i.e. February 20 at 6 o'clock pm, the zones have moved as is revealed in FIG. 5B, where zone $\alpha$ now comprises the sections 5–13, whereas zone $\beta$ comprises the sections 17–25 (the zones are moving in the direction of the arrows). On account of the difference in the heating cycle, the distance between front section 13 of the zone $\alpha$ and the end section 17 of the zone $\beta$ is reduced to three sections, 14–16. This is the shortest possible distance being necessary to remove the baked carbon bodies from the pits of zone $\beta$ (section 15) and to insert new green carbon bodies into the pits of zone $\alpha$ (section 14) which is now the front section of zone $\alpha$. To maintain a constant distance between the zones, zone $\beta$ from now on has to be run on 48 hour heating cycle.

In the other end of the zones, where section 25 is the front section of zone $\alpha$ and section 5 is the end section of zone $\alpha$, the distance is correspondingly prolonged, i.e. there is a distance of about 9 sections (sections 1–4 and 26–39).

As the zone $\alpha$ has moved through sections 1,2,3 and 4, the baked carbon bodies have been removed from the pits of these sections and the tearing down of the sections 1–3 with adjacent section walls can start (it is still February 20).

The sections contain a large amount of refractory material, and due to the short cooling period, the temperature is still high when the work is started. Mechanical devices are therefore used for this work, which will not be further described here.

3. The rebuilding of section one is already started 1 day after the tearing down started, i.e. on February 21. The rebuilding is time consuming, and section 1 will therefore not be included as the front section of zone $\beta$ before March 3., i.e. 12 days after the tearing down of this section started.

Figure 5C:
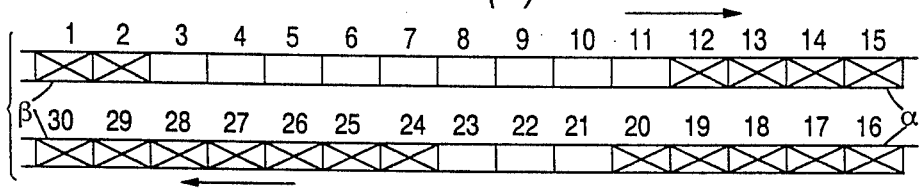

4. On the 5th of March, when section 2 is entering zone $\beta$, the renovation works have to be finished. The zone relation at this point in time is shown in FIG. 5C, where zone $\beta$ comprises the sections 1–2 and 24–30, whereas zone $\alpha$ comprises the sections 12–20. It is now the 5th of March, 6 o'clock pm, and zone $\beta$, with section 2 in front is set to a 42 hour heating cycle. The other zone, $\alpha$, is run with the same heating cycle, i.e., 48 hours. The rerunning of the zones to normal operation has now started.

This rerunning is for simplicity's sake, shown in the table below. It shows the day and time the individual section enters the firing zones, as well as the altering of the heating cycle.

| Date | Time | Section | Heating cycle |
|---|---|---|---|
| | Section entering zone $\alpha$ | | |
| March 5. | 1800 | 20 | 48 hours |
| March 7. | 1800 | 21 | |
| March 9. | 1800 | 22 | |
| March 11. | 1800 | 23 | |
| March 13. | 1800 | 24 | 42 hours |
| March 15. | 1200 | 25 | |
| March 17. | 0600 | 26 | |
| March 18. | 2400 | 27 | 37 hours |
| March 20. | 1200 | 28 | |
| March 21. | 2400 | 29 | |
| March 23. | 1200 | 30 | |
| March 24. | 2400 | 01 | |
| March 26. | 1200 | 02 | 30 hours |
| | Section entering zone $\beta$ | | |
| March 5. | 1800 | 02 | 42 hours |
| March 7. | 1200 | 03 | |
| March 9. | 0600 | 04 | |
| March 10. | 2400 | 05 | 36 hours |
| March 12. | 1200 | 06 | |
| March 13. | 2400 | 07 | 30 hours |
| March 15. | 0600 | 08 | |
| March 16. | 1200 | 09 | |
| March 17. | 1800 | 10 | |
| March 18. | 2400 | 11 | |
| March 20. | 0600 | 12 | |
| March 21. | 1200 | 13 | |
| March 22. | 1800 | 14 | |
| March 23. | 2400 | 15 | |
| March 25. | 0600 | 16 | |
| March 26. | 1200 | 17 | |

Figure 5D:
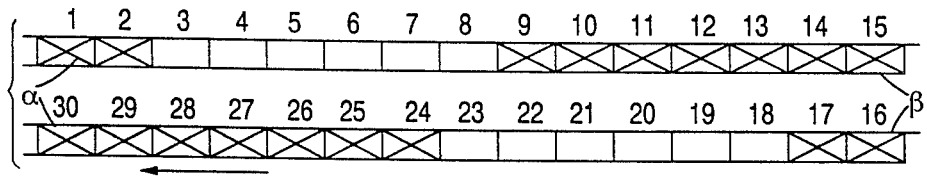

5. As will appear from the above tables, the heating cycle is gradually set back to regular running. Regarding zone $\beta$, the heating cycle is returned to normal operation, i.e. 30 hour heating cycle, on the 13th of March. The 26th of March, zone $\alpha$ is also returned to normal operation, and the distance between the zones is the same at both ends, i.e. six sections with open lids between the zones as shown in FIG. 5D.

In the above example the method according to the invention is applied on a ring section furnace comprising 30 sections with two firing zones. However, the method can obviously be applied on ring section furnaces with fewer or more sections and with more than two firing zones, for instance 48 sections and three firing zones.

Figure 6A:
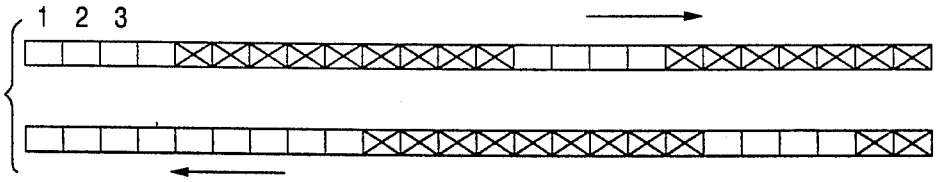
FIGS. 6(*a*) and (*b*) are diagrams illustrating the firing zone situation for different steps of the present method for a ring section furnace with three firing zones.
Figure 6B:
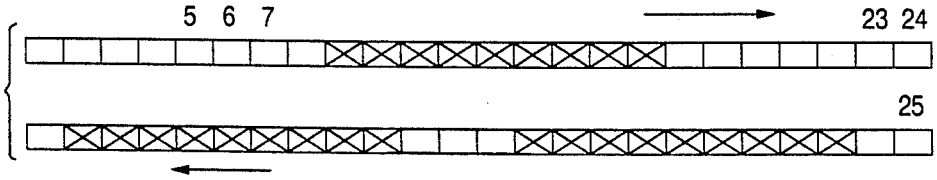

Now, referring to FIG. 6 which illustrates a last example, the method according to the invention can be performed in two ways;

(a) The zones can be run asymmetrically and the renovation can be accomplished after the sections of the last zone has passed (sections 1,2,3 and 4) as shown in FIG. 6A, or (b) Two zones are run asymmetrically with three sections in-between, whereby the renovation can be accomplished at two places in the furnace, i.e. after the singular zone (sections 5,6 and 7), and after the two zones (sections 23,24 and 25 ), as shown in FIG. 6B. In a similar way, ring section furnaces with more sections and more firing zones can be successively be renovated.

We claim:

1. A method of renovating a ring section furnace, said furnace having a plurality of sections each of which alterntes between a heating cycle and an inactive period, and said furnace normally operating with a number of said sections in said heating cycle, said sections in said heating cycle being substantially grouped to define a plurality of firing zones separated by the remaining ones of said sections which are in said inactive period, said sections defining each said firing zone beginning and ending their respective heating cycle at staggered intervals whereby said firing zones remain discrete and progress through said plurality of sections, said method comprising the steps of:

altering the duration of said firing cycle for less than all of said firing zones, whereby the number of said sections in said inactive period which border at least one of said firing zones increases at one end of said at least one of said firing zones; and performing renovation work on at least one of said sections in said inactive period which borders said at least one of said firing zones at said one end thereof.

2. A method as in claim 1, wherein said step of altering the duration of said firing cycle comprises increasing the duration of said firing cycle.

3. A method as in claim 1, further comprising, subsequent to said altering step and prior to said renovation step, the step of:

altering the duration of said firing cycle for the remaining ones of said firing zones to match the duration of said firing cycle for said less than all of said firing zones, whereby the number of said sections in said inactive period which border each of said firing zones remains constant.

4. A method as in claim 3, wherein said step of altering the duration of said firing cycle comprises increasing the duration of said firing cycle.

5. A method as in claim 3, further comprising, subsequent to said renovation step, the step of:

successively altering the duration of said firing cycle for said less than all of said firing zones and for said remaining ones of said firing zones, to different extents, until the number of said sections in said inactive period which border each of said fitting zones and the duration of the firing cycle for all of said firing zones are substantially the same as prior to the initial altering step.

6. A method as in claim 5, wherein said step of altering the duration of said firing cycle comprises increasing the duration of said firing cycle, and wherein said step of successively altering the duration of said firing cycle comprises successively decreasing the duration of said firing cycle.

* * * * *